US008770774B2

(12) United States Patent
Ye et al.

(10) Patent No.: US 8,770,774 B2
(45) Date of Patent: Jul. 8, 2014

(54) VENTILATION FAN WITH LIGHTS

(75) Inventors: Long-Sing Ye, Taoyuan Hsien (TW); Yueh-Shan Lin, Taoyuan Hsien (TW); Wen-Hsiang Lin, Taoyuan Hsien (TW); Te-Chung Liu, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 237 days.

(21) Appl. No.: 13/350,836

(22) Filed: Jan. 16, 2012

(65) Prior Publication Data

US 2013/0088855 A1 Apr. 11, 2013

(30) Foreign Application Priority Data

Oct. 11, 2011 (TW) ..... 100136674 A

(51) Int. Cl.

| | |
|---|---|
| ***F21V 33/00*** | (2006.01) |
| ***F21V 3/00*** | (2006.01) |
| ***F21V 5/00*** | (2006.01) |
| ***F24F 13/078*** | (2006.01) |
| *F21K 99/00* | (2010.01) |
| *F21V 3/04* | (2006.01) |

(52) U.S. Cl.

CPC ..... *F21V 33/0096* (2013.01); *F24F 13/078* (2013.01); *F21K 9/50* (2013.01); *F21V 3/049* (2013.01); *F21V 5/002* (2013.01)

USPC ..... 362/96; 362/235; 362/246; 362/311.02; 362/330; 362/355; 454/293

(58) Field of Classification Search

CPC ..... F21V 5/002; F21V 5/004; F21V 5/005; F21V 31/00; F21V 31/005; F21V 33/0096; F21V 3/00; F21V 3/049; F21Y 2101/02; F24F 13/078; F21K 9/00; F21K 9/50

USPC ..... 362/235–237, 244, 246, 267, 311.02, 362/330, 339, 800, 96, 351, 355, 375; 454/293–295

See application file for complete search history.

(56) References Cited

U.S. PATENT DOCUMENTS

| | | | | |
|---|---|---|---|---|
| 4,931,915 | A * | 6/1990 | Quiogue | 362/267 |
| 5,388,035 | A * | 2/1995 | Bodem, Jr. | 362/545 |
| 5,580,156 | A * | 12/1996 | Suzuki et al. | 362/184 |
| 5,820,247 | A * | 10/1998 | Schuler | 362/96 |

(Continued)

FOREIGN PATENT DOCUMENTS

| | | |
|---|---|---|
| CN | 101761904 | 6/2010 |
| TW | 200902906 | 1/2009 |

*Primary Examiner* — Alan Cariaso
(74) *Attorney, Agent, or Firm* — CKC & Partners Co., Ltd.

(57) ABSTRACT

A ventilation fan with lights includes an exhaust fan, a lid, and an illumination apparatus. The lid covers an entrance of the exhaust fan. The lid has plural exhaust gratings and an opening. The exhaust gratings are arranged at least adjacent to opposite sides of the opening. The illumination apparatus is embedded in the opening of the lid. The illumination apparatus includes a lamp housing, a lamp plate, plural light emitting diodes (LEDs), a lampshade, and plural scattering microstructures. LEDs are arranged on the lamp plate. The lampshade covers the lamp housing. The lampshade and the lamp housing cooperate to define a lamp chamber therebetween. The lamp plate and the LEDs are disposed in the lamp chamber. The scattering microstructures are disposed on an inner surface of the lampshade facing the lamp chamber.

14 Claims, 15 Drawing Sheets

(56) References Cited

U.S. PATENT DOCUMENTS

| | | | | |
|---|---|---|---|---|
| 5,863,113 | A * | 1/1999 | Oe et al. | 362/620 |
| 5,934,783 | A * | 8/1999 | Yoshikawa | 362/96 |
| 7,037,073 | B2 * | 5/2006 | Lin | 416/5 |
| 7,070,310 | B2 * | 7/2006 | Pond et al. | 362/545 |
| 8,021,011 | B2 * | 9/2011 | Gomi | 362/97.3 |
| 8,147,099 | B2 * | 4/2012 | Thornton | 362/299 |
| 8,297,811 | B2 * | 10/2012 | Mukai et al. | 362/470 |
| 8,419,217 | B2 * | 4/2013 | Lu et al. | 362/249.02 |
| 8,506,117 | B2 * | 8/2013 | Hung et al. | 362/235 |
| 2008/0013315 | A1 | 1/2008 | Kim et al. | |
| 2010/0009621 | A1 | 1/2010 | Hsieh | |

* cited by examiner

VENTILATION FAN WITH LIGHTS

RELATED APPLICATIONS

This application claims priority to Taiwan Application Serial Number 100136674, filed Oct. 11, 2011, which is herein incorporated by reference.

BACKGROUND

1. Technical Field

Embodiments of the present invention relate to a ventilation fan. More particularly, embodiments of the present invention relate to a ventilation fan with lights.

2. Description of Related Art

In modern life, ventilation fans are widely applied in many buildings for inhaling and circulating indoor air. The apparatus can help eliminate odor, and thus, it is often installed on a ceiling of a toilet room. In addition to the ventilation fan, a lamp is indispensable in an ordinary toilet room. Therefore, in order to meet requirements of both illumination and ventilation, the lamp and the ventilation fan have to be installed on the ceiling.

Various ventilation fans with lights are consequently developed. In the existing ventilation fan with lights, a tungsten lamp or a bulb is typically employed for illumination. Because the tungsten lamp or the bulb are too large, the ventilation fan cannot be minimized, and the air flow will be limited by the size of the entrance of the ventilation fan, thus reducing ventilation ability would be reduced and causing noise to be generated.

SUMMARY

In one aspect of the present invention, an illuminating apparatus of a ventilation fan with lights comprises a lamp housing, a lamp plate, a plurality of light emitting diodes (LEDs), a lampshade, and a plurality of scattering microstructures. LEDs are arranged on the lamp plate. The lampshade covers the lamp housing and cooperates with the lamp housing to define a lamp chamber between them. The lamp plate and the LEDs are disposed in the lamp chamber. The scattering microstructures are disposed on an inner surface of the lampshade facing the lamp chamber.

In another aspect of the present invention, an embodiment of a control system of a ventilation fan with lights comprises a power source, a plurality of LEDs, at least one switch, and a control circuit. The LEDs are electrically connected to the power source. The control circuit is electrically connected to the power source, the LEDs, and the switch. The control circuit comprises a primary illumination module, a secondary illumination module, a shutdown module, and a control module. The primary illumination module is used for activating all of the LEDs. The secondary illumination module is used for activating at least some of the LEDs. The shutdown module is used for deactivating all of the LEDs. The control module is used for selectively activating one of the primary illumination module, the secondary illumination module, and the shutdown module corresponding to a state of the switch.

In still another aspect of the present invention, an embodiment of a ventilation fan with lights comprises an exhaust fan, a lid, and an illumination apparatus. The lid covers an entrance of the exhaust fan, and has a plurality of exhaust gratings and an opening, wherein the exhaust gratings are arranged at least adjacent to opposite sides of the opening. The illumination apparatus is embedded in the opening of the lid. As the embodiment mentioned above, the illumination apparatus comprises a lamp housing, a lamp plate, a plurality of LEDs, a lampshade, and a plurality of scattering microstructures. The LEDs are arranged on the lamp plate. The lampshade covers the lamp housing and cooperates with the lamp housing to define a lamp chamber therebetween. The lamp plate and the LEDs are disposed in the lamp chamber. The scattering microstructures are disposed on an inner surface of the lampshade facing the lamp chamber.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
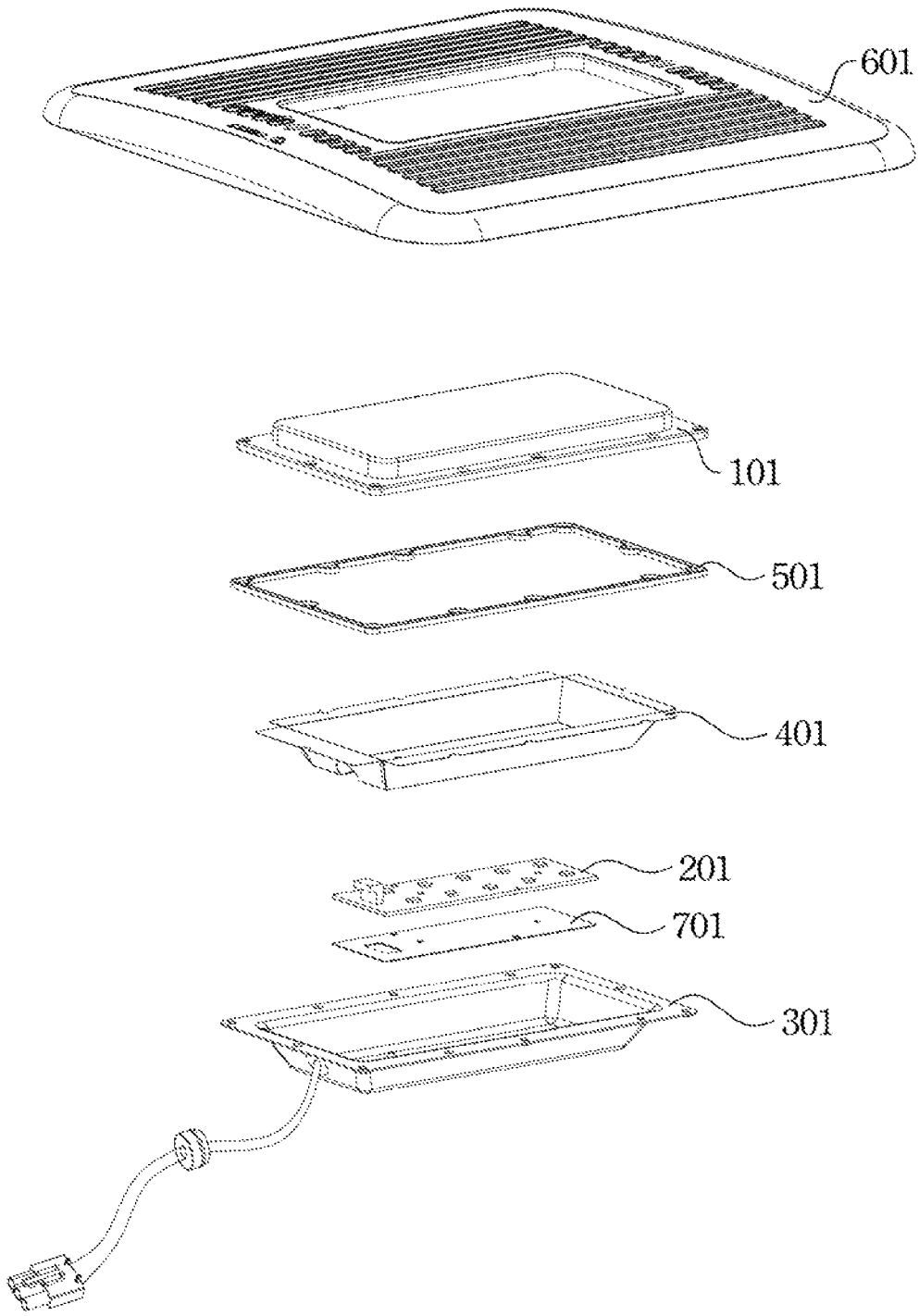
FIG. 1 is a schematic explosive diagram of a lid and an illumination apparatus in accordance with one embodiment of the present invention.

Reference will now be made in detail to the present embodiments of the invention, examples of which are illustrated in the accompanying drawings. Wherever possible, the same reference numbers are used in the drawings and the description to refer to the same or like parts.

Figure 2:
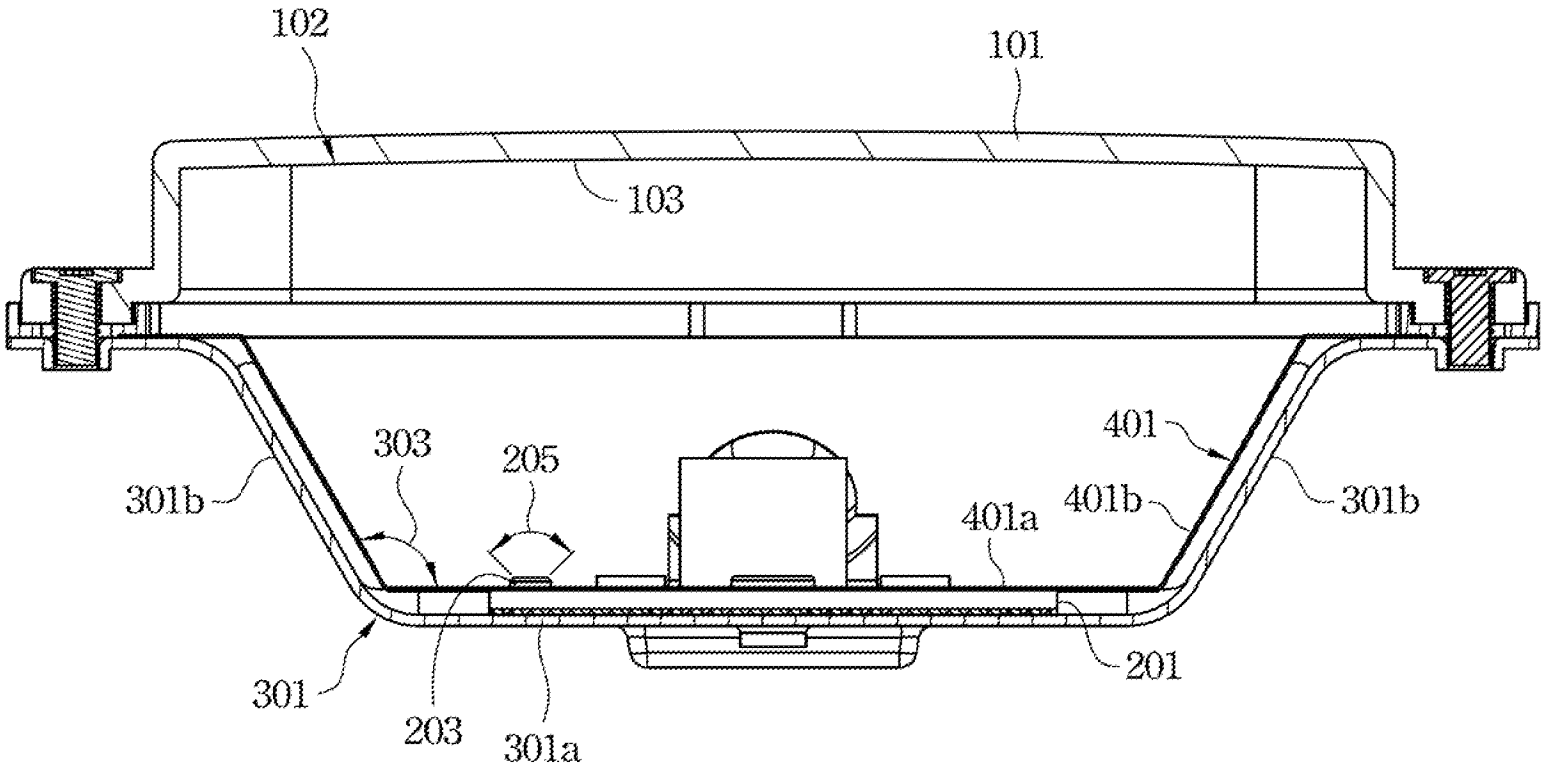
FIG. 2 is a schematic cross-sectional diagram of the illumination apparatus shown in FIG. 1.

FIG. 1 is a schematic explosive diagram of a lid and an illumination apparatus in accordance with one embodiment of the present invention. FIG. 2 is a schematic cross-sectional diagram of the illumination apparatus shown in FIG. 1. As shown in FIG. 1 and FIG. 2, an illumination apparatus of a ventilation fan with lights comprises a lamp housing 301, a lamp plate 201, a plurality of LEDs 203, a lampshade 101, and a plurality of scattering microstructures 103. LEDs 203 are arranged on the lamp plate 201. The lampshade 101 covers the lamp housing 301 and cooperates with the lamp housing 301 to define a lamp chamber 102 between them. The lamp plate 201 and the LEDs 203 are disposed in the lamp chamber 102. The scattering microstructures 103 are disposed on an inner surface of the lampshade 101 facing the lamp chamber 102.

By means of aforementioned technical features, the illumination apparatus of the embodiment of the present invention may employ numerous LEDs to illuminate. Because the LED 203 is small, the illumination apparatus can be minimized. Moreover, a plurality of scattering microstructures 103 may be disposed on the inner surface of the lampshade 101 facing the lamp chamber 102, so as to reduce the discomfort arising when a user directly views the illumination apparatus. Further, the scattering microstructures 103 may facilitate to alleviate total reflection of light, thereby optimizing the balance between the transmittance and the haziness of the lampshade. For example, the transmittance of the lampshade can be adjusted to reach about 82%, and the haziness thereof can be adjusted to reach about 100%. Specifically, a critical angle is an incident angle at which total reflection is minimized, and the incident angle is measured from a normal line of a refractive interface. The critical angle can be determined by Snell's Law, as shown in the following.

$$\theta_c = \arcsin\frac{n_2}{n_1}.$$

In Snell's Law, $n_1$ and $n_2$ represent refractive indexes of both sides of the interface. Briefly speaking, the light extraction rate can be maximized when the critical angle is 90 degree, and the light extraction rate of the scattering microstructures 103 of this embodiment can reach about 83%.

In the embodiment, the lamp housing 301 comprises a base 301*a* and at least one sidewall 301*b*. The base 301*a* holds the lamp plate 201, and the sidewall 301*b* is tilted at an angle 303 relative to the base 301*a*. The angle 303 is substantially the same as an emission angle 205 of the LED 203. In other words, the lamp housing 301 includes a base 301*a* and a sidewall 301*b*, the sidewall 301*b* is disposed on edges of the base 301*a* and tilted at the angle 303 relative to the base 301*a*, wherein the angle 303 is substantially the same as the emission angle 205 of the LED 203. In an embodiment of the present invention, the emission angle 205 may be 120 degrees, and thus, the angle 303 included between the base 301*a* and the sidewall 301*b* may be 120 degrees. Because the angle 303 included between the base 301*a* and the sidewall 301*b* is substantially the same as the emission angle 205 of the LED 203, the reflection of light emitted from the LED 203 may be enhanced, thereby improving the illumination ability and controlling the temperature at the interface between the LED 203 and the lamp plate 201 to be lowered than 75° C.

It should be noted that the term "substantially" or "about" is introduced herein to describe any tiny variations which may not influence the essence. For example, the feature "the angle 303 is substantially the same as the emitting angle 205" means that an angle 303 which is slightly different from the emitting angle 205 is also allowable if the "slightly different" angle 303 can also assist reflecting light of the LED 203, in addition to the angle 303 which is exactly the same as the emitting angle 205.

In the embodiment, the illumination apparatus further comprises an optical reflective film 401. The optical reflective film 401 covers an inner surface of the lamp plate 201 and the lamp housing 301 facing the lamp chamber 102, and has a plurality of holes to expose the LEDs 203. In this embodiment, the optical reflective film 401 may be attached to the inner surface of the lamp housing 301, so that the shape of the optical reflective film 401 can be the same as the lamp housing 301. That is, the optical reflective film 401 includes a bottom film 401*a* and at least one side film 401*b*. The bottom film 401*a* covers the lamp plate 201 and comprises a plurality of holes to expose the LEDs 203. The side film 401*b* tilted at an angle relative to the bottom film 401 and the angle is substantially the same as an emission angle of the LEDs 203. Thus, the optical reflective film 401 may also be tilted at an angle 303 which is ubstantially the same as the emitting angle 205 of the LED 203 for facilitating the light reflection. In some embodiments, the optical reflective film 401 is a polyester film with high optical reflective ability, such as a white polyester film. As a result, the optical reflective film 401 may assist the light reflection, thereby promoting the transmittance of the illumination apparatus, wherein the increased extent of the transmittance can reach at least 20%.

Figure 3:
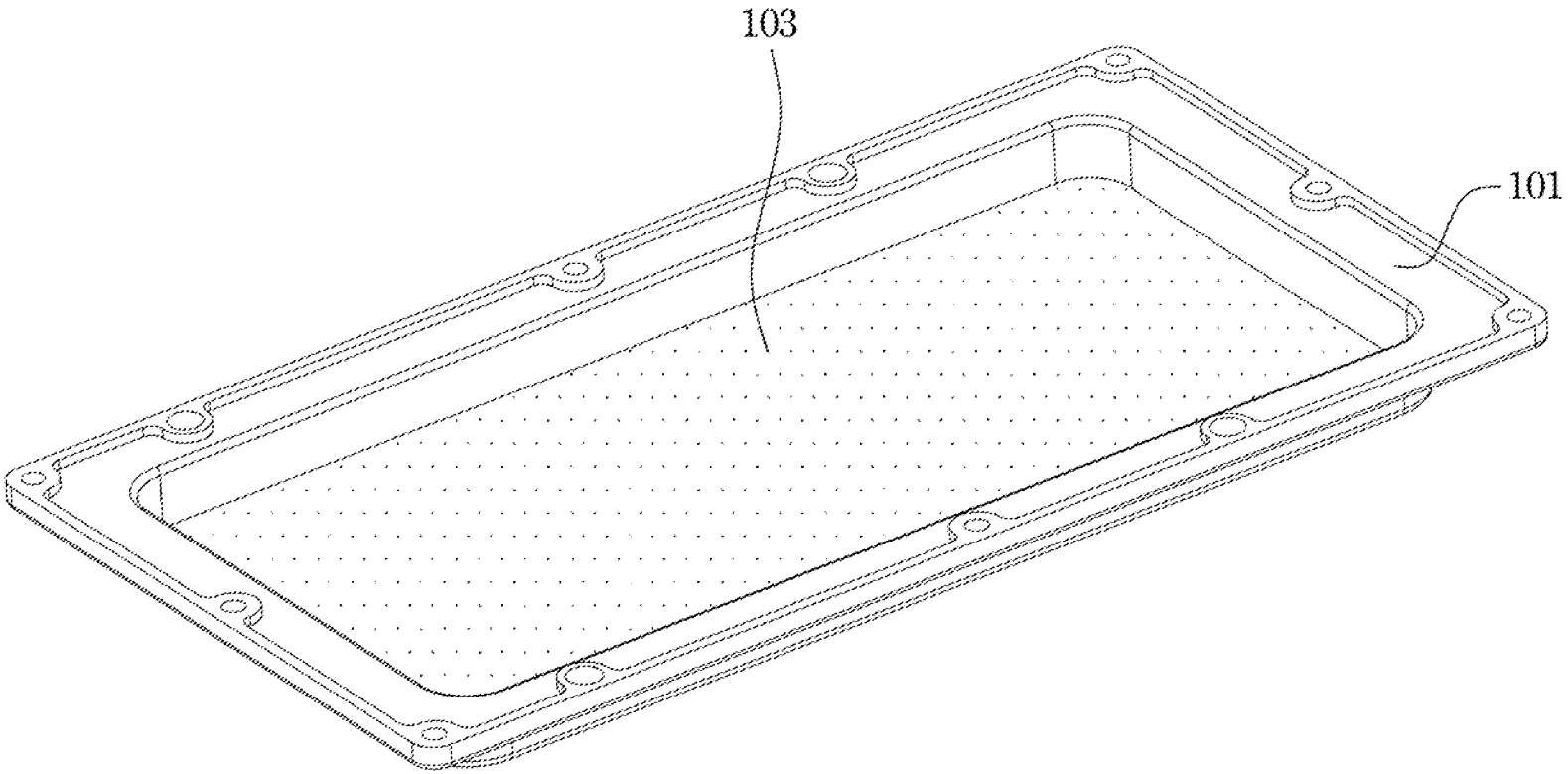
FIG. 3 is a schematic diagram of the lampshade of FIG. 2 viewed from a lamp chamber.

FIG. 3 is a schematic diagram of the lampshade 101 of FIG. 2 viewed from a lamp chamber. As shown in FIG. 3, numerous scattering microstructures 103 are disposed on the inner surface of the lampshade 101 facing the lamb chamber (referring to FIG. 2). In other words, numerous scattering microstructures 103 may be randomly or regularly arranged on the inner surface of the lampshade 101. These scattering microstructures 103 make the inner surface of the lampshade 101 much more rougher, so that the total reflection can be alleviated and the discomfort arising from directly viewing the illumination apparatus can be reduced, and thus, the balance between the transmittance and the haze of the lampshade 101 may be optimized.

Figure 4A:
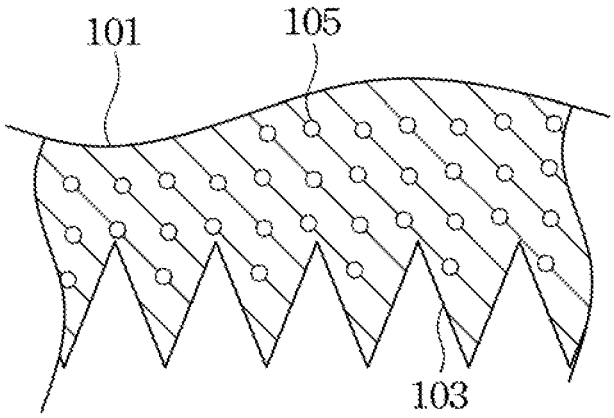
FIG. 4A is a schematic cross-sectional diagram of scattering microstructures in accordance with the embodiment shown in FIG. 3.

FIG. 4A is a schematic cross-sectional diagram of scattering microstructures in accordance with the embodiment shown in FIG. 3. As shown in FIG. 4A, the scattering microstructures 103 of the embodiment are formed as triangular prisms. Specifically, in the cross-sectional view, the profile of the scattering microstructures 103 has regularly or irregularly triangular convexes or concaves, so as to alleviate the total reflection of light. Moreover, a plurality of scattering particles 105 may be blended in the lampshade 101 to further scatter light, thereby obtaining required transmittance and haziness.

Figure 4B:
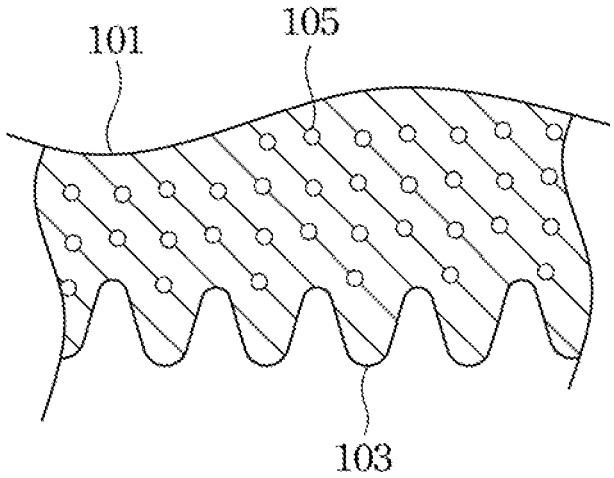
FIG. 4B is a schematic cross-sectional diagram of scattering microstructures in accordance with another embodiment of the present invention.

FIG. 4B is a schematic cross-sectional diagram of scattering microstructures in accordance with another embodiment of the present invention. As shown in FIG. 4B, the scattering microstructures 103 of the embodiment are formed as curved cylinders. Specifically, in the cross-sectional view, the profile of the scattering microstructures 103 has regularly or irregularly wave outlines, so as to alleviate the total reflection of light. Moreover, a plurality of scattering particles 105 may be blended in the lampshade 101 to further scatter light, thereby obtaining required transmittance and haze.

Figure 4C:
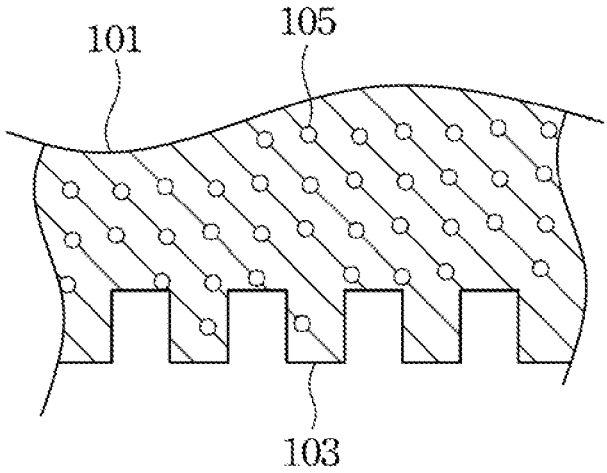
FIG. 4C is a schematic cross-sectional diagram of scattering microstructures in accordance with still another embodiment of the present invention.

FIG. 4C is a schematic cross-sectional diagram of scattering microstructures in accordance with still another embodiment of the present invention. As shown in FIG. 4C, the scattering microstructures 103 of the embodiment are formed as rectangular prisms. Specifically, in the cross-sectional view, the profile of the scattering microstructures 103 has regularly or irregularly rectangular convexes or concaves, so as to alleviate the total reflection of light. Moreover, a plurality of scattering particles 105 may be blended in the lampshade 101 to further scatter light, thereby obtaining required transmittance and haze.

In addition to aforementioned embodiments, the scattering microstructures 103 may also be any combinations of the triangular prisms, the curved cylinders, and the rectangular prisms. It should be noted that the embodiments shown in FIG. 4A to FIG. 4C are merely used to explain the scattering microstructures 103, but not to limit the present invention.

Figure 5A:
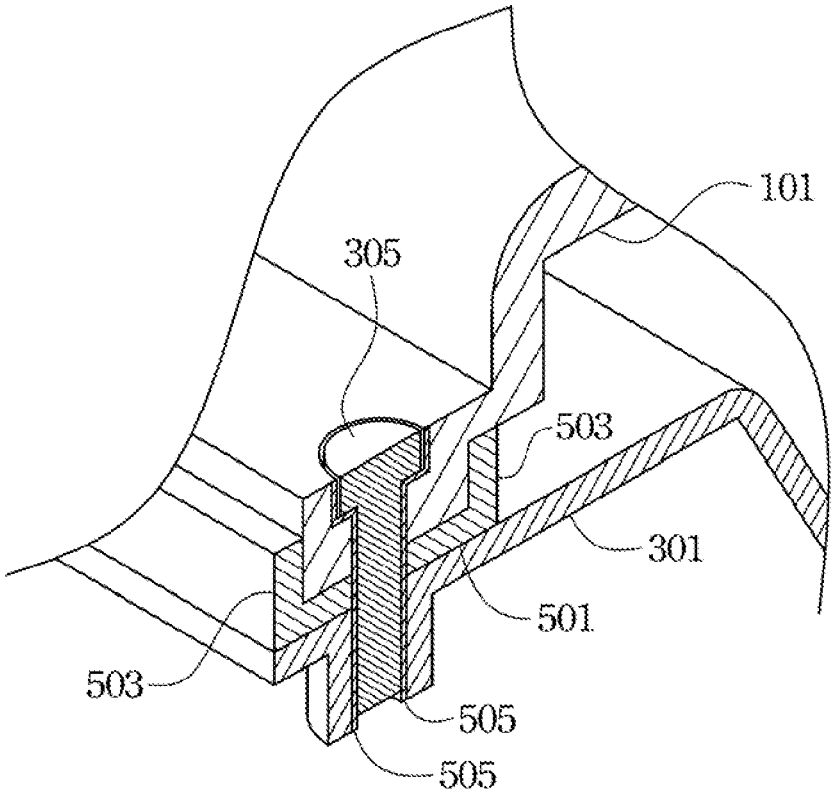
FIG. 5A is a schematic diagram showing a combination of the lampshade and the lamp housing of FIG. 1.

FIG. 5A is a schematic diagram showing a combination of the lampshade 101 and the lamp housing 301 of FIG. 1. As shown in FIG. 5A, the illumination apparatus further comprises a fastening member 305 that fastens the lampshade 101 and the lamp housing 301 together. In other words, when fastening the lampshade 101 and the lamp housing 301, the fastening member 305 may pass through the lampshade 101 and part of the lamp housing 301 to combine the lampshade 101 and the lamp housing 301. In some embodiments, the fastening member 305 may be (include, but be not limited to) a bolt or a screw, etc. Male screw threads may be formed on the surface of the fastening member 305, and female screw threads may be formed on the surface of the lampshade 101 and the lamp housing 301 contacting the fastening member 305, so that the fastening member 305 may be screwed into the lampshade 101 and the lamp housing 301. In this embodiment, the illumination apparatus comprises a waterproof washer 501 disposed between the lampshade 101 and the lamp housing 301 for preventing water from leaking into the illumination apparatus. For example, the waterproof washer 501 may be made of the waterproof silicone. In some embodiments, in order to improve the waterproof ability, a layer of waterproof glue 505 may be filled in gaps among the lampshade 101, the waterproof washer 501, the lamp housing 301, and the fastening member 305, so as to ensure that water cannot leak into the illumination apparatus.

In this embodiment, two lateral washers 503 are extended from opposite edges of the waterproof washer 501 and bended along the lampshade 101. Namely, the lateral washer 503 is stuck to the lampshade 101 and bended upwards along the profile of the lampshade 101.

Figure 5B:
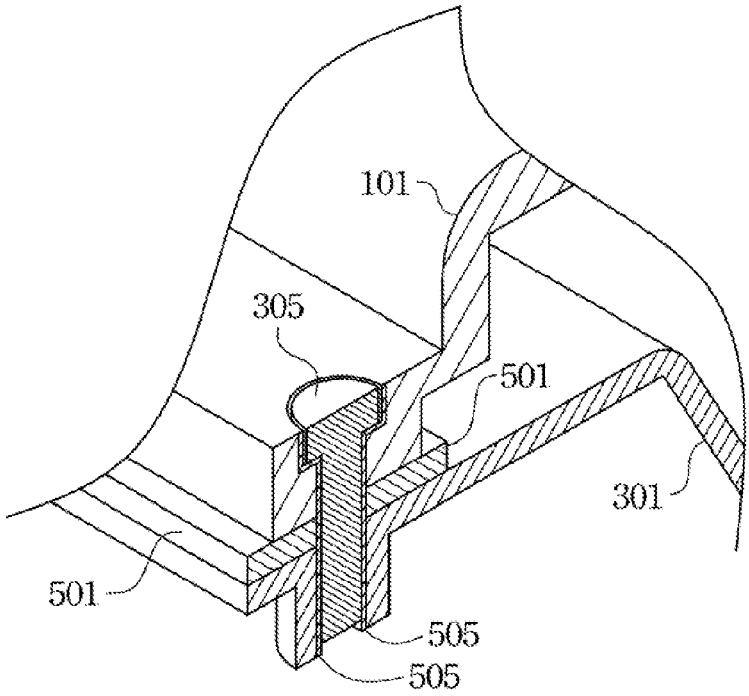
FIG. 5B is a schematic diagram showing a combination of the lampshade and the lamp housing in accordance with another embodiment of the present invention.

FIG. 5B is a schematic diagram showing a combination of the lampshade 101 and the lamp housing 301 in accordance with another embodiment of the present invention. This embodiment is generally similar to that shown in FIG. 5A, and the main difference between them is that no later washer is extended from the waterproof washer 501 in this embodiment.

Figure 5C:
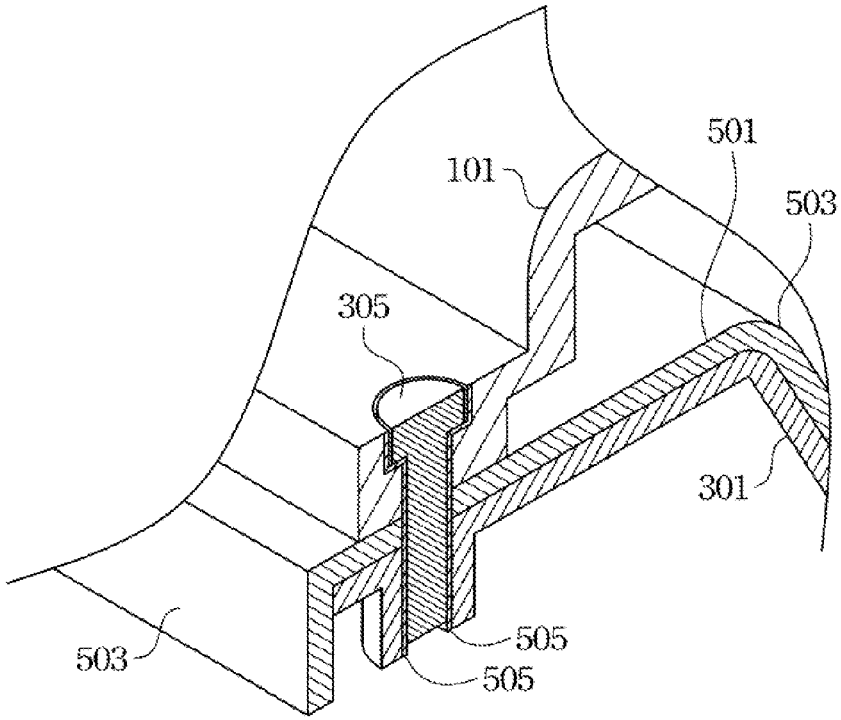
FIG. 5C is a schematic diagram showing a combination of the lampshade and the lamp housing in accordance with still another embodiment of the present invention.

FIG. 5C is a schematic diagram showing a combination of the lampshade 101 and the lamp housing 291 in accordance with still another embodiment of the present invention. This embodiment is generally similar to that shown in FIG. 5B, and the main difference between them is that two lateral washers 503 are extended from opposite edges of the waterproof washer 501 and bended along the lamp housing 301. In other words, the sheet 503 is attached on the lamp housing 301 and bended downwards along the profile of the lamp housing 301.

Figure 6:
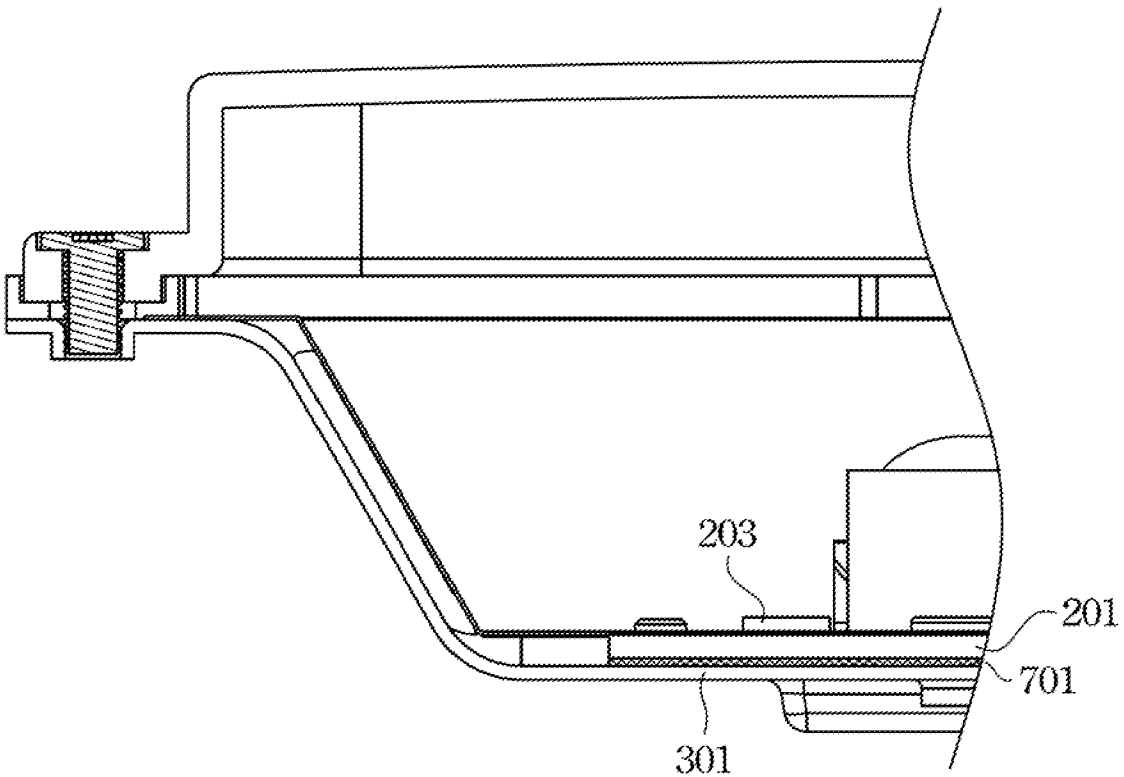
FIG. 6 is a schematic cross-sectional diagram showing a portion of the illumination apparatus of FIG. 1.

FIG. 6 is a schematic cross-sectional diagram showing a portion of the illumination apparatus of FIG. 1. As shown in FIG. 6, the illumination apparatus may comprise a heat conductive pad 701 thermally contacting the lamp plate 201 and the lamp housing 301, so as to transfer the heat generated by the LED 203 on the lamp plate 201 to the lamp housing 301 via heat conduction. In other words, the heat conductive pad 701 is disposed between the lamp housing 301 and the surface of the lamp plate 201 opposite to the LED 203 as to transfer heat. The heat conductive pad 701 may be an insulated sheet doped with heat conductive material such as copper or aluminum. For example, the heat conductive pad 701 may be a sheet with low electrical conductivity and high thermal conductivity that is made of polyester fiber. Because the lamp housing 301 of the embodiment can be made of heat conductive material such as aluminum, when heat is transferred to the lamp housing 301, it can be dissipated by an external airflow via heat convection. By implementing the heat conductive pad 701, the thermal resistance may be lowered to less than 3° C./W. Furthermore, because the heat conductive pad 701 is insulated, the illumination apparatus may be provided with the insulation ability higher than 500 Vac.

Figure 7:
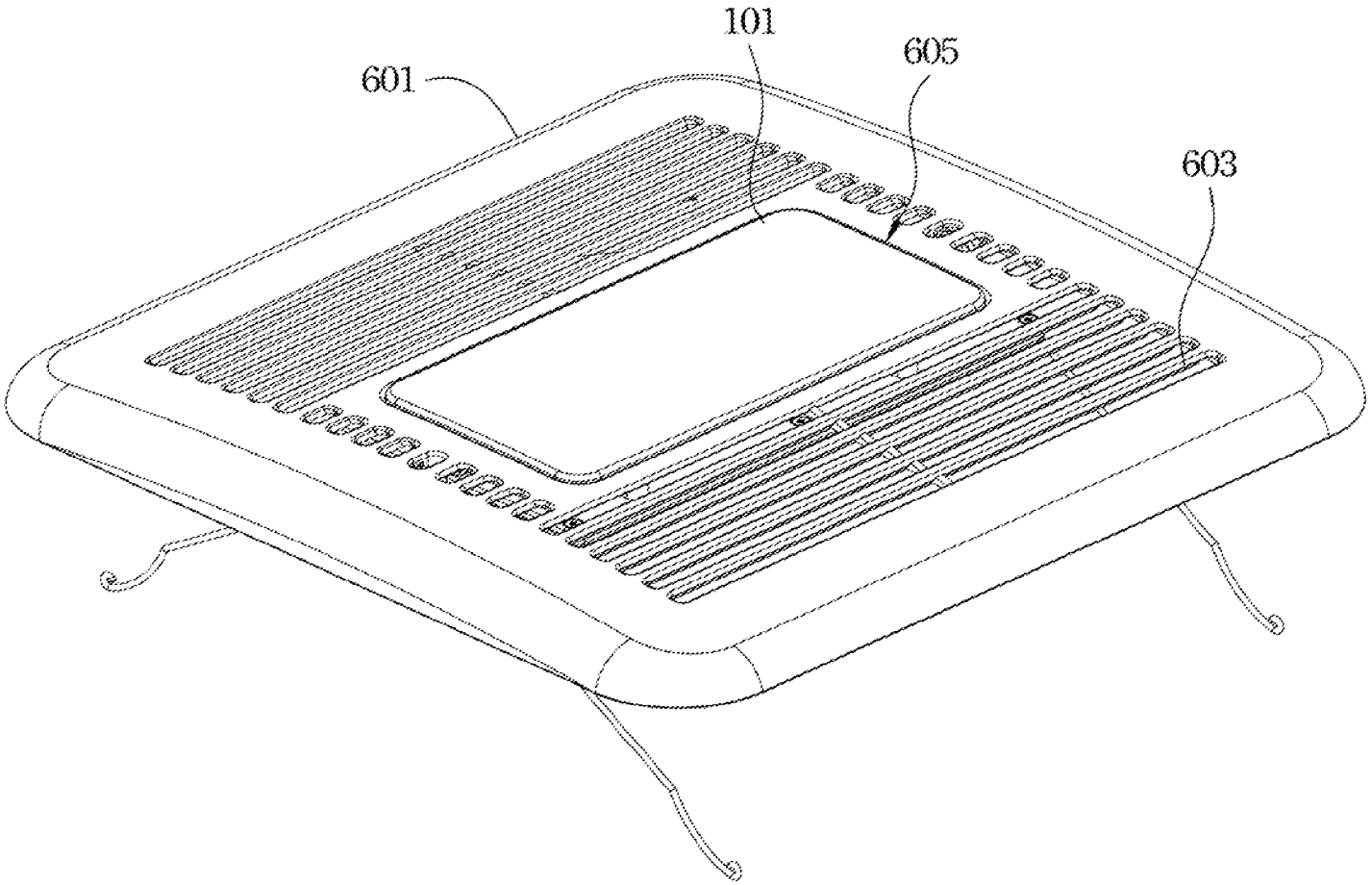
FIG. 7 is a schematic diagram of the lid shown in FIG. 1.

FIG. 7 is a schematic diagram of the lid 601 shown in FIG. 1. The lid 601 comprises a plurality of exhaust gratings 603 and an opening 605, and the exhaust gratings are at least arranged on two opposite sides of the opening 605 for allowing air flow to pass through. Specifically, the opening 605 is formed at the center of the lid 601 for embedding the illumination apparatus to perform illumination. For example, light may be emitted out of the lampshade 101 to perform illumination. Numerous of exhaust gratings 603 may be formed near the opening 605 for facilitating exhausting air.

Figure 8:
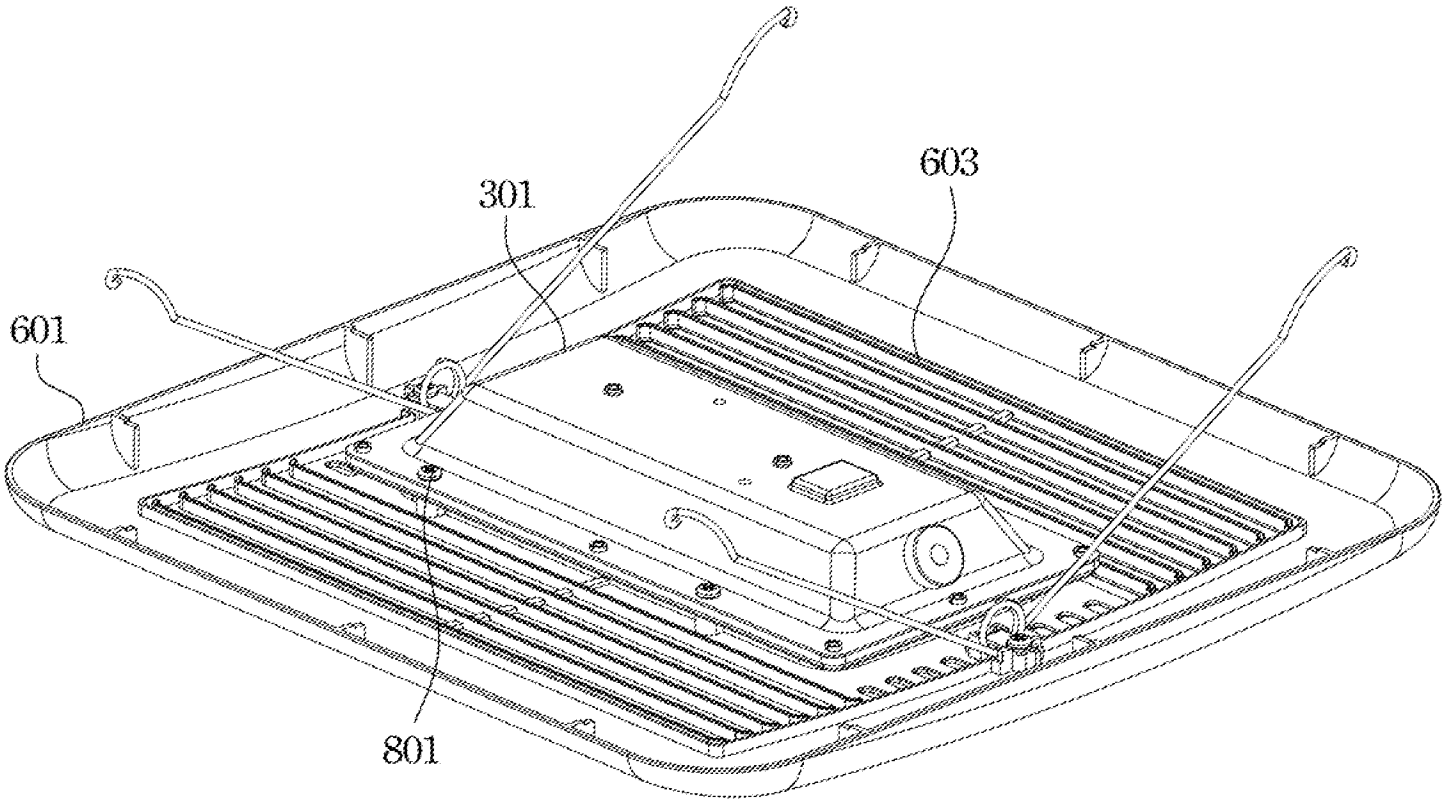
FIG. 8 is a schematic diagram of the illumination apparatus and the lid shown in FIG. 1 viewed from the backside of the illumination apparatus.

FIG. 8 is a schematic diagram of the illumination apparatus and the lid 601 shown in FIG. 1 viewed from the backside of the illumination apparatus. The illumination apparatus is embedded in the opening of the lid 601. As shown in FIG. 8, the lamp housing 301 covers the opening of the lid 601, and the lampshade (referring to FIG. 7) is embedded into the opening of the lid 601. In this embodiment, fixing members 801 may be further introduced to fix the lamp housing 301 on the lid 601, so that the lid 601 and the illumination apparatus can be fastened. In some embodiments, the fixing member 801 may include, but is not limited to, a bolt, or a screw, etc.

Figure 9:
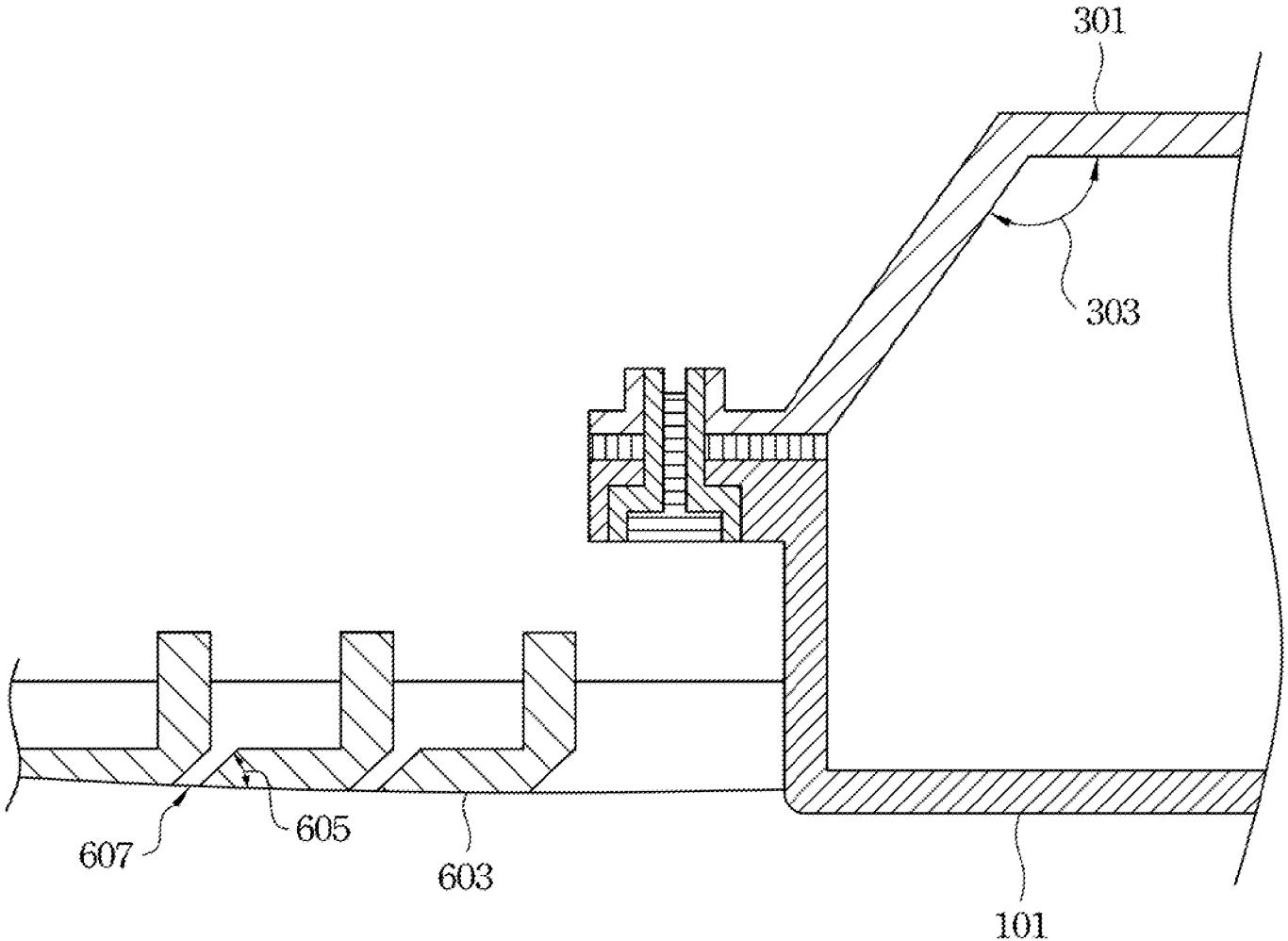
FIG. 9 is a schematic cross-sectional diagram of exhaust gratings of FIG. 1.

FIG. 9 is a schematic cross-sectional diagram of exhaust gratings of FIG. 1. Because the illumination apparatus formed by the combination of the lampshade 101 and the lamp housing 301 is embedded in the opening of the lid, the exhaust gratings 603 are arranged at opposite sides of the illumination apparatus. In the embodiment, plural ventilation channels 607 are introduced. The ventilation channel 607 may be defined by adjacent ones of the exhaust gratings 603, and may be orientated towards the illumination apparatus. In some embodiments, an angle 605 is formed between the bottom and the side of the exhaust grating 603, and the tilt angle of the ventilation channel 607 is substantially the same as the angle 605. By means of the aforementioned technical features, the air may flow through the ventilation channel 607 that is tilted. Moreover, the angle 605 may be determined to be the supplementary angle of the angle 303 formed between the base and the sidewall of the lamp housing 301, namely, the summation of the angle 605 and the angle 303 may be 180 degree. As a result, air passing through the ventilation channel 607 may flow along the lamp housing 301 more fluently, so that the wind resistance may be lowered and the heat conductive area may be increased about 20%, thereby meeting the heat dissipation ability required for the illumination apparatus without any additional heat dissipation fin. Furthermore, because no heat dissipation fin is required, the weight can be reduced, so as to facilitate the manufacture of the ventilation fan and to enhance safety of the ventilation fan. Moreover, the ventilation channel 607 may omit the risk that water drops on the lid 601 since it is tilted.

Figure 10:
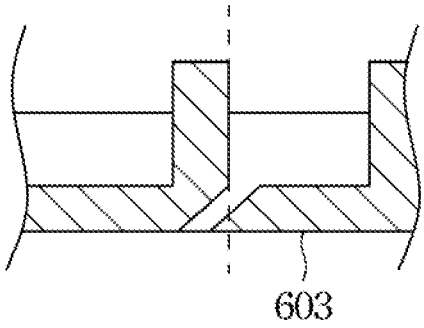
FIG. 10 is a schematic cross-sectional diagram showing two adjacent exhaust gratings of FIG. 9.

FIG. 10 is a schematic cross-sectional diagram showing two adjacent exhaust gratings of FIG. 9. As shown in FIG. 10, adjacent ones of the exhaust gratings 603 shelter each other partially for preventing water splashing onto the lid. On the other hand, if water is condensed on the lid, adjacent exhaust gratings 603 partially sheltering each other may also prevent water from dropping directly to the area below the lid. Specifically, by viewing from the dotted line of FIG. 10, only the edge of an exhaust grating 603 can be seen, while the edge of another exhaust grating 603 is sheltered. As a result, water from the ambience can be prevented from splashing onto the lid, and the condensed water on the lid can be prevented from dropping to the area below the lid.

Figure 11:
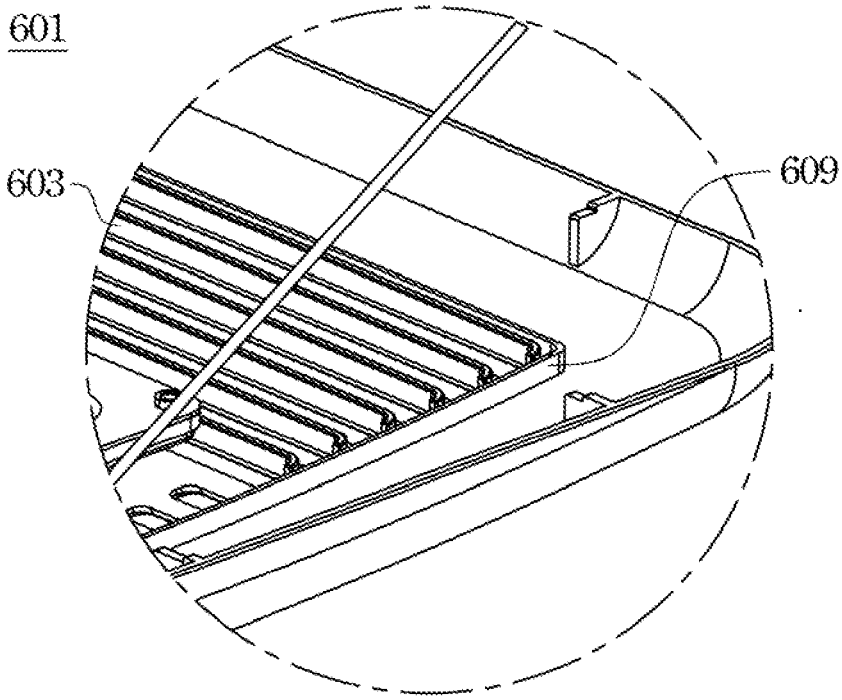
FIG. 11 is a schematic locally enlarged diagram of the lid of FIG. 1.

FIG. 11 is a schematic locally enlarged diagram of the lid focusing on the edge of the exhaust gratings 603 of FIG. 1. As shown in FIG. 11, the ventilation fan with lights of the embodiment further comprises a droplet-proof fence 609 for preventing water droplets from falling, wherein the droplet-proof fence 609 is disposed on an inner surface of the lid 601 facing the exhaust fan (not shown in this figure), and the droplet-proof fence 609 surrounds the exhaust gratings 603. In other words, the droplet-proof fence 609 is disposed around the profile formed by those exhaust gratings 603, and the droplet-proof fence 609 may be a wall protruding from the inner surface of the lid 601 for holding the water condensed or received on the lid 601 and preventing the water from dropping to the ambience via the ventilation channel between the exhaust gratings 603.

Figure 12:
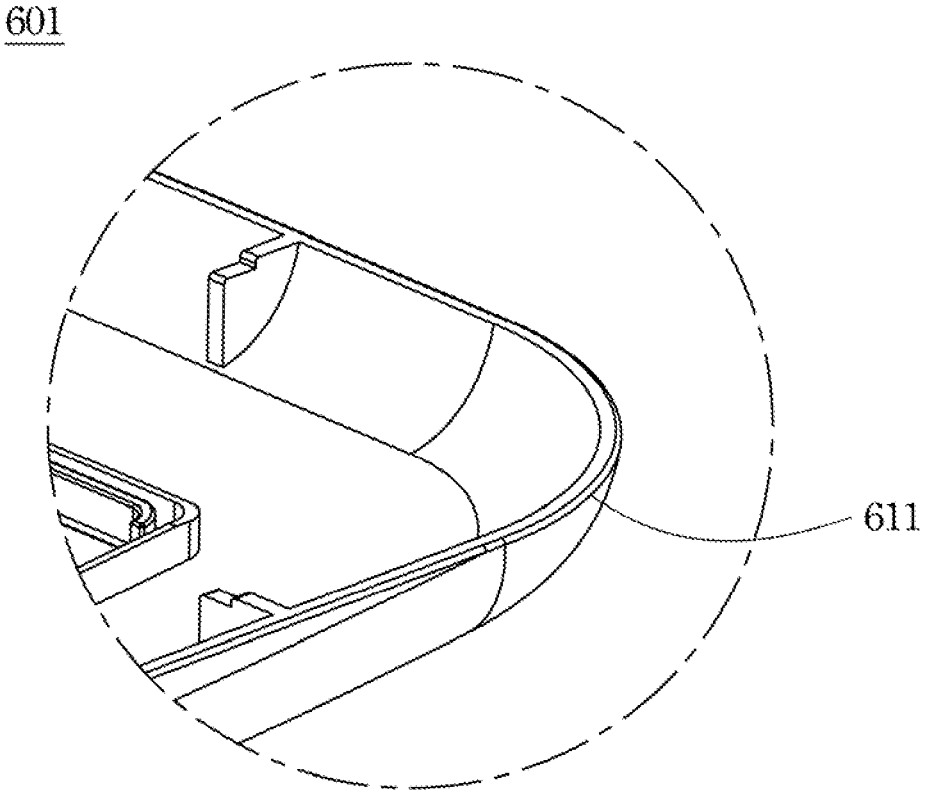
FIG. 12 is another schematic locally enlarged diagram of the lid of the lid of FIG. 1.

FIG. 12 is a schematic locally enlarged diagram focusing on the edge of the lid of FIG. 1. As shown in FIG. 12, the lid 601 has round corners 611, so as to prevent the user from hurt when touching the lid 601.

Figure 13:
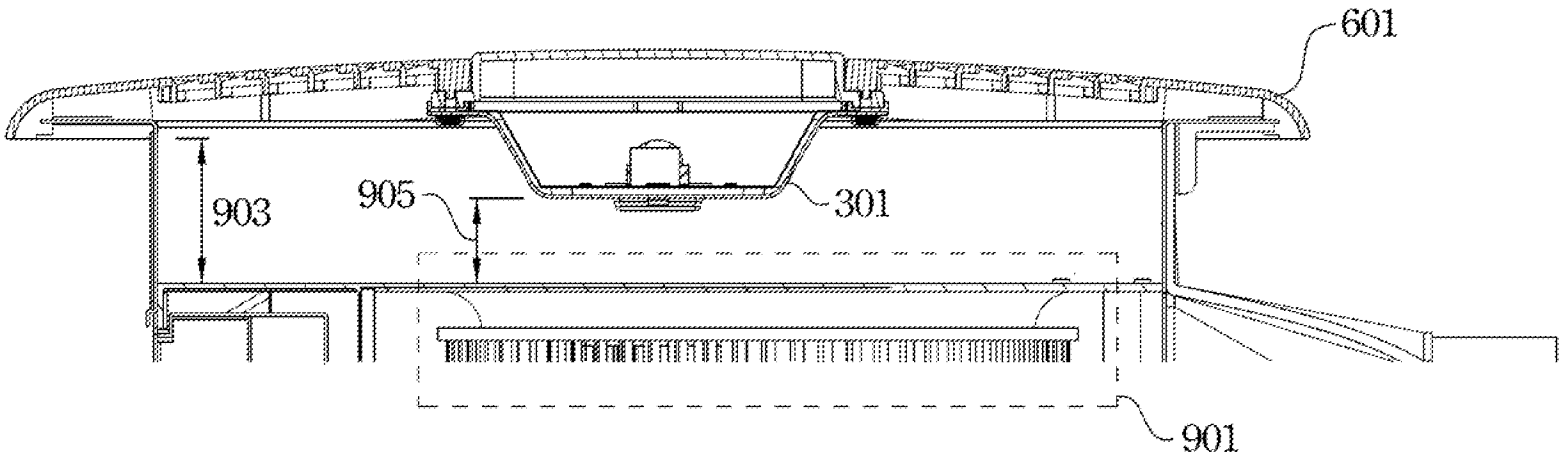
FIG. 13 is a schematic cross-sectional diagram of the ventilation fan with lights of FIG. 1.

FIG. 13 is a schematic cross-sectional diagram of the ventilation fan with lights of FIG. 1. As shown in FIG. 13, the lid 601 covers the entrance of the exhaust fan 901. Because the illumination apparatus of the embodiment employs LEDs to perform illumination, the thickness of the illumination apparatus can be reduced, so that the distance 905 between the exhaust fan 901 and the illumination apparatus can be about 30~50% of the depth of the entrance 903. In other words, the distance 905 between the bottom of the lamp housing 301 and the top of the exhaust fan 901 is about 30~50% of the depth of the entrance 903. With respect to an ordinary size of the entrance depth, the distance 905 between the bottom of the lamp housing 301 and the top of the exhaust fan 901 is at least about 25 mm. It should be noted that aforementioned size, determined by the ordinary entrance depth, is just for explaining, but not for limiting the present invention. The proportion between the length and the width of the illumination apparatus in accordance with the embodiment is about 1:1.8. The area of the illumination apparatus is about 55~60% of the lid 601. The percentage of open area of the lid 601 is about 40~45%. As a result, the ventilation fan can be minimized, and ventilation and illumination ability can be optimized, and the LED can further save energy.

In accordance with the embodiment of the present invention, the total transmittance can reach at least 92%, and the thermal resistance can be lowered than 5 W/m·k, and the temperature at the interface between the LED chip and the lamp plate can be lowered than 75° C.

Figure 14:
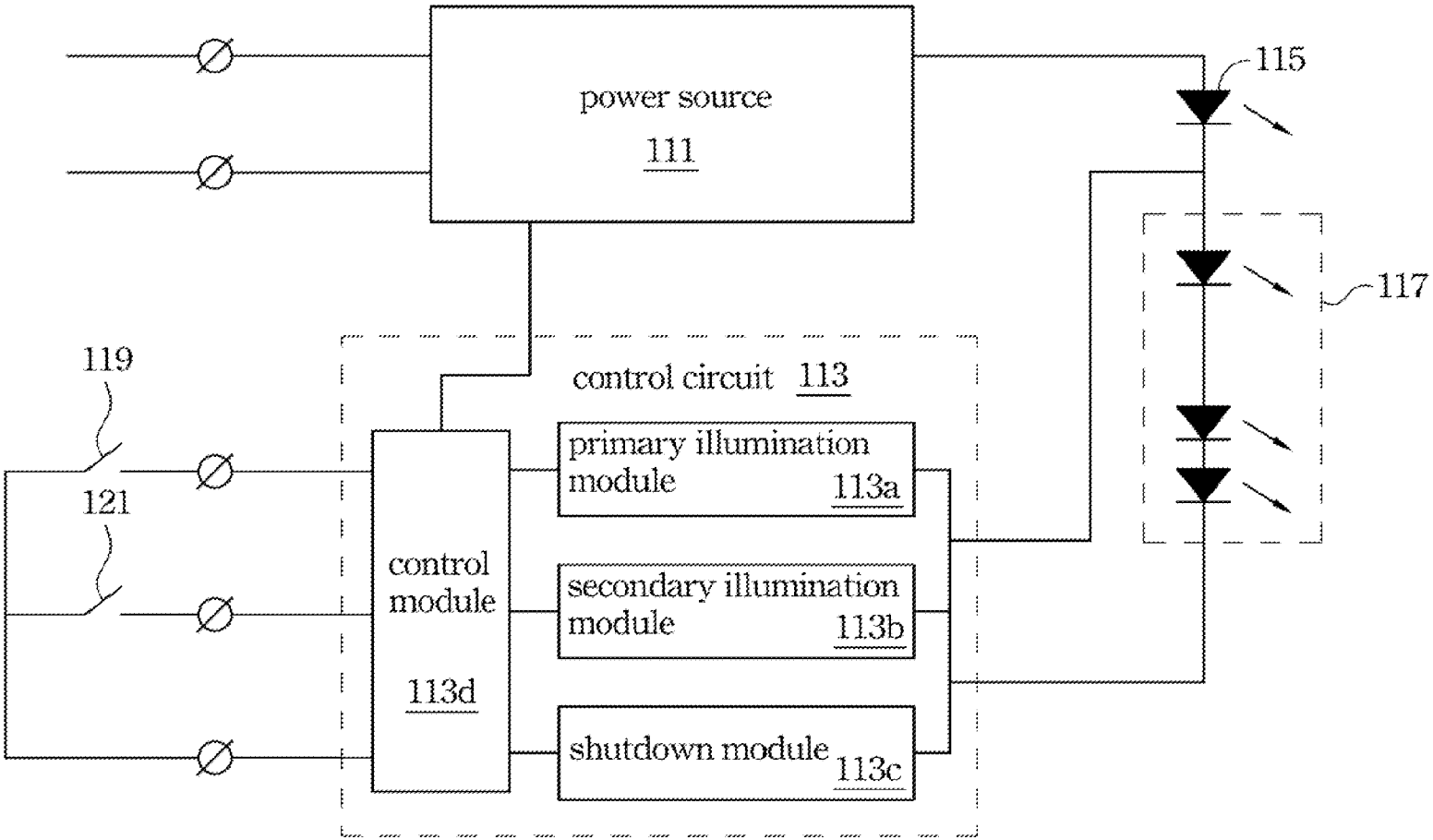
FIG. 14 is a block diagram of a control system of the ventilation fan with lights in accordance with an embodiment of the present invention

FIG. 14 is a block diagram of a control system of the ventilation fan with lights in accordance with an embodiment of the present invention. As shown in FIG. 14, the control system comprises a power source 111, a plurality of LEDs 115, 117, a first switch 119, a second switch 121 and a control circuit 113. In this embodiment, the LEDs 115, 117 are electrically connected to the power source 111. The control circuit 113 is electrically connected to the power source 111, the LEDs 115, 117, the first switch 119, and the second switch 121. The control circuit 113 comprises a primary illumination module 113*a*, a secondary illumination module 113*b*, a shutdown module 113*c*, and a control to module 113*d*. The primary illumination module 113*a* is used for activating all of the LEDs (namely, the LEDs 115, 117 are all activated). The secondary illumination module 113*b* is used for activating at least a portion of the LEDs (For example, only LED 115 is activated). The shutdown module 113*c* is used for deactivating all of the LEDs (namely, the LEDs 115, 117 are all deactivated). The control module 113*d* is used for activating one of the primary illumination module 113*a*, the secondary illumination module 113*b*, and the shutdown module 113*c* corresponding to the switch (such as the first switch 119 and/or the second switch 121).

By means of the aforementioned technical features, the control system in accordance with the embodiment may activate all of the LEDs (including LEDs 115, 117) or at least a portion of LEDs (for example, only LED 115 is activated) by operating the primary illumination module 113*a* or the secondary illumination module 113*b*, thereby providing light with two different luminances, so that the user may have different illumination modes to be chosen.

The operation manners of the primary illumination module 113*a* and the secondary illumination module 113*b* by using the first switch 119 and the second switch 121 are shown as follows.

| operation | first switch 119 | second switch 121 |
|---|---|---|
| activating primary illumination module 113a | on | off |
| activating secondary illumination module 113b | off | on |
| activating primary illumination module 113a | on | on |
| deactivating primary illumination module 113a and secondary illumination module 113b | off | off |

As shown, the control module 113*d* is configured for activating the primary illumination module 113*a* when the first switch 119 is turned on. The control module 113*d* is configured for activating the secondary illumination module 113*b* when the second switch 121 is turned on. The control module 113*d* is configured for activating the shutdown module 113*c* when the first switch 119 and the second switch 121 are both turned off, wherein the shutdown module 113*c* is used to deactivating the primary illumination module 113*a* and the secondary illumination module 113*b*. Moreover, the control module 113*d* is configured for activating the primary illumination module 113*a* when the first switch 119 and the second switch 121 are both turned on. Aforementioned operation manners are just for explaining, not limiting the present invention.

In some embodiments, the secondary illumination module 113*b* is used for activating all of the LEDs (including LEDs 115, 117), but for controlling these LEDs 115, 117 to emit light with only partial power, so that the luminance of the secondary illumination module 113*b* and the luminance of the primary illumination module 113*a* are distinguishable.

Figure 15:
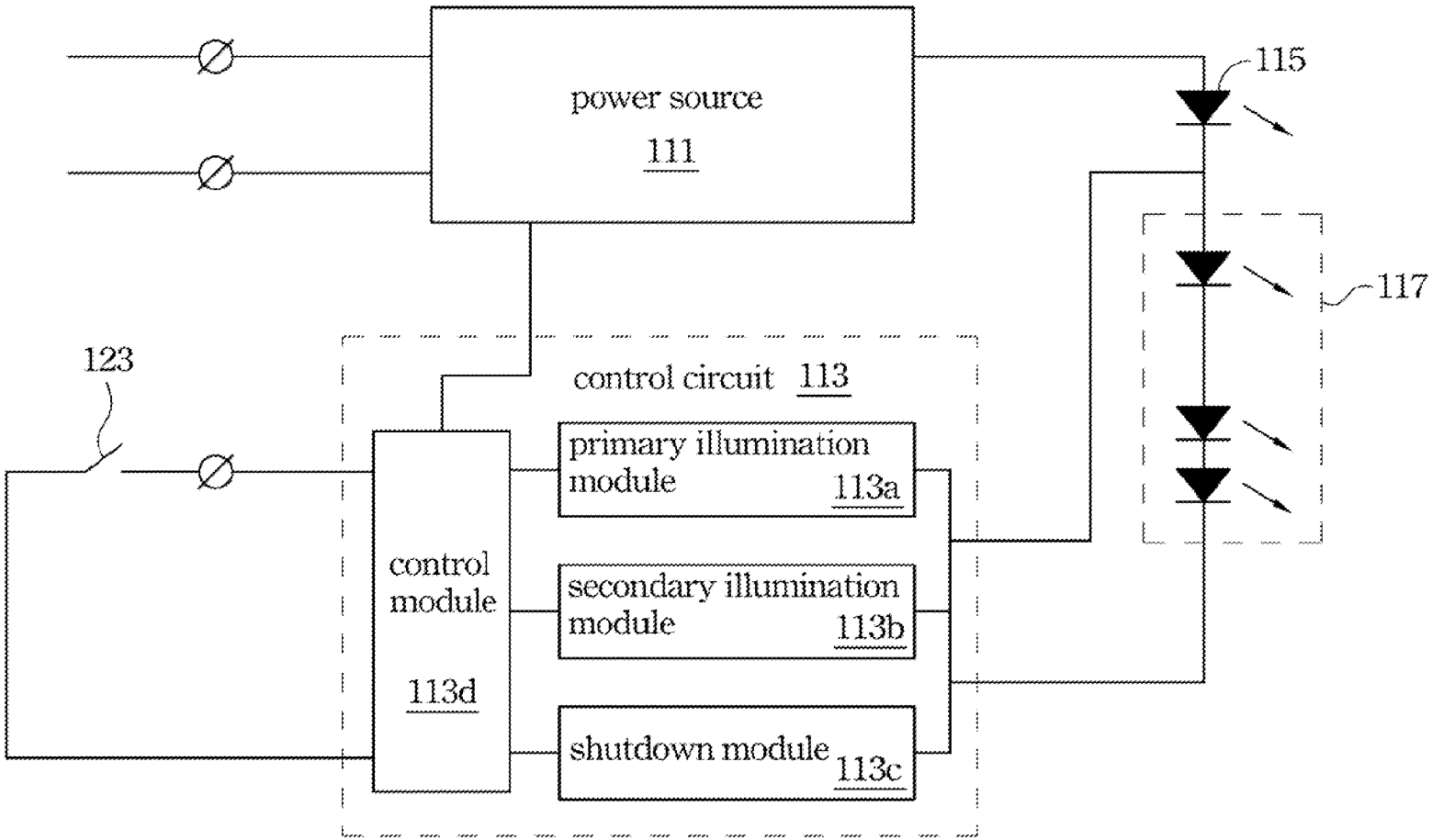
FIG. 15 is a block diagram of a control system of the ventilation fan with lights in accordance with another embodiment of the present invention.

FIG. 15 is a block diagram of a control system of the ventilation fan with lights in accordance with another embodiment of the present invention. The control system is generally similar to that shown in FIG. 14, and the main difference is that only one cyclic switch 123 is employed to operate the control circuit 113. In this embodiment, the cyclic switch 123 may be cyclically switched to operate the control circuit 113. Specifically, the control module 113*d* is configured for cyclically activating the primary illumination module 113*a*, the secondary illumination module 113*b*, and the shutdown module 113*c* corresponding to the cyclic switch 123. For example, the primary illumination module 113*a* is activated when the cyclic switch 123 is pressed once; the secondary illumination module 113*b* is activated when the cyclic switch 123 is pressed twice; the primary illumination module 113*a* and the secondary illumination module 113*b* both are not activated when the cyclic switch 123 is pressed three times. The operation manners of the cyclic switch 123 are just described for explanation, but not for limiting the present invention.

In some embodiments, the power source 111 is a DC (direct current) power source, such as an AC/DC converter.

It will be apparent to those skilled in the art that various modifications and variations can be made to the structure of the present invention without departing from the scope or spirit of the invention. In view of the foregoing, it is intended that the present invention covers modifications and variations of this invention provided they fall within the scope of the following claims.

What is claimed is:

1. An illumination apparatus for a ventilation fan with lights, the illumination apparatus comprising:

a lamp housing;

a lamp plate;

a plurality of light emitting diodes (LEDs) arranged on the lamp plate;

a lampshade which covers the lamp housing and cooperates with the lamp housing to define a lamp chamber between the lampshade and the lamp housing, wherein the lamp plate and the LEDs are disposed in the lamp chamber; and a plurality of scattering microstructures disposed on an inner surface of the lampshade facing the lamp chamber;

wherein the lamp housing comprises:

a base for supporting the lamp plate; and at least one sidewall tilted at an angle relative to the base, wherein the angle is the same as an emission angle of the LEDs.

2. The illumination apparatus according to claim 1, wherein the angle is substantially 120 degree.

3. The illumination apparatus according to claim 1, further comprising:

an optical reflective film covering an inner surface of the lamp plate and the lamp housing facing the lamp chamber, the optical reflective film having a plurality of holes to expose the LEDs.

4. The illumination apparatus according to claim 3, wherein the optical reflective film is a white polyester film.

5. The illumination apparatus according to claim 3, wherein the optical reflective film comprises:

a bottom film covering the lamp plate, the bottom film having the holes used for exposing the LEDs; and at least one side film tilted at an angle relative to the bottom film, wherein the angle is the same as the emission angle of the LEDs.

6. The illumination apparatus according to claim 1, wherein the scattering microstructures are formed as triangular prisms, rectangular prisms, curved cylinders or combinations thereof.

7. The illumination apparatus according to claim 1, further comprising:

at least one fastening member for fastening the lampshade and the lamp housing;

a waterproof washer disposed between the lampshade and the lamp housing; and at least one waterproof glue layer filled in gaps among the lampshade, the waterproof washer, the lamp housing, and the fastening member.

8. The illumination apparatus according to claim 7, further comprising:

two lateral washers which extend from two opposite edges of the waterproof washer and are bended along the lampshade.

9. The illumination apparatus according to claim 7, further comprising:

two lateral washers which extend from two opposite edges of the waterproof washer and are bended along the lamp housing.

10. The illumination apparatus according to claim 1, further comprising:

a heat conductive pad thermally contacting the lamp plate and the lamp housing.

11. A ventilation fan with lights, comprising:

an exhaust fan;

a lid covering an entrance of the exhaust fan, the lid having a plurality of exhaust gratings and an opening, wherein the exhaust gratings are at least arranged on two opposite sides of the opening; and an illumination apparatus embedded in the opening of the lid, the illumination apparatus comprising:

a lamp housing;

a lamp plate;

a plurality of light emitting diodes (LEDs) arranged on the lamp plate;

a lampshade which covers the lamp housing and cooperates with the lamp housing to define a lamp chamber between the lampshade and the lamp housing, wherein the lamp plate and the LEDs are disposed in the lamp chamber; and a plurality of scattering microstructures disposed on an inner surface of the lampshade facing the lamp chamber.

12. The ventilation fan with lights according to claim 11, further comprising:

a plurality of ventilation channels which are defined by the exhaust gratings adjacent to each other and are inclined towards the illumination apparatus, wherein the exhaust gratings shelter each other partially.

13. The ventilation fan with lights according to claim 11, further comprising:

a droplet-proof fence disposed on an inner surface of the lid facing the exhaust fan for preventing water droplets from falling, the droplet-proof fence surrounding the exhaust gratings, wherein an edge of the lid is a round corner.

14. The ventilation fan with lights according to claim 11, wherein a distance between the exhaust fan and the illumination apparatus is substantially 30-50% of a depth of the entrance.

* * * * *